United States Patent [19]

Brocklebank et al.

[11] Patent Number: 4,773,814

[45] Date of Patent: Sep. 27, 1988

[54] EARTH MOVING MACHINE

[75] Inventors: Norman Brocklebank, Beverley; Alan Cooper, Stoke on Trent, both of United Kingdom

[73] Assignee: J. C. Bamford Excavators Limited, Rocester, United Kingdom

[21] Appl. No.: 802,789

[22] Filed: Nov. 27, 1985

[30] Foreign Application Priority Data

Dec. 1, 1984 [GB] United Kingdom ..... 8430389

[51] Int. Cl.[4] ..... E02F 5/02

[52] U.S. Cl. ..... 414/695.5; 414/719; 212/198

[58] Field of Search ..... 414/719, 694, 695.5; 212/195, 197, 198; 37/103, 114, 116

[56] References Cited

U.S. PATENT DOCUMENTS

| | | | |
|---|---|---|---|
| 1,718,434 | 6/1929 | Ronk | 212/170 |
| 2,526,613 | 10/1950 | Tanguy | 212/49 |
| 2,763,385 | 9/1956 | Harrison . | |
| 3,734,326 | 5/1973 | Esser | 414/719 X |
| 4,403,771 | 9/1983 | Kasahara et al. | 187/25 X |
| 4,493,602 | 1/1985 | Koerber | 187/24 X |
| 4,494,906 | 1/1985 | Brocklebank et al. | 414/719 |
| 4,600,085 | 7/1986 | Gagnon et al. | 187/24 |
| 4,679,336 | 7/1987 | Brocklebank et al. | 414/719 X |

FOREIGN PATENT DOCUMENTS

| | | | |
|---|---|---|---|
| 1008407 | 4/1977 | Canada | 414/719 |
| 0077684 | 10/1982 | European Pat. Off. . | |
| 2447488 | 1/1980 | France . | |
| 1233337 | 1/1967 | Fed. Rep. of Germany . | |
| 1431951 | 11/1968 | Fed. Rep. of Germany | 212/195 |
| 2602898 | 1/1976 | Fed. Rep. of Germany . | |
| 197709 | 9/1977 | U.S.S.R. | 414/719 |
| 589204 | 1/1978 | U.S.S.R. | 212/195 |
| 1222797 | 3/1969 | United Kingdom . | |
| 1463952 | 1/1975 | United Kingdom . | |
| 2014109 | 1/1979 | United Kingdom . | |
| 8300037 | 6/1982 | PCT Int'l Appl. . | |

*Primary Examiner*—Joseph J. Rolla
*Assistant Examiner*—Nils E. Pedersen
*Attorney, Agent, or Firm*—Robert C. Baker

[57] ABSTRACT

The earth moving machine has a body having a ground engaging propulsion device and a base frame mounted on the ground engaging propulsion device. The base frame is movable relative to the ground engaging propulsion device about a first generally vertical axis. A boom extends outwardly of the body and is mounted on the base frame for movement about a second axis transverse relative to the first axis. The boom has a dipper arm mounted at an outer end thereof for movement about a third axis also transverse to the vertical axis. An excavating implement is mounted at an outer end of the dipper arm for movement about a fourth axis also transverse relative to the first vertical axis. A hydraulic ram is mounted between the dipper arm and the boom to effect movement of the dipper arm relative to the boom and hence to effect movement of the implement towards and away from the body. A counterweight is mounted on the base frame, and elements are provided for moving the counterweight towards or away from the first vertical axis in response to movement of the dipper arm relative to the boom towards or away from the body.

2 Claims, 4 Drawing Sheets

EARTH MOVING MACHINE

BACKGROUND TO THE INVENTION

This invention relates to an earth moving machine, that is a machine having a body movable by its own propulsion means over the ground, and a boom mounted on the body, the boom and/or an additional arm mounted thereon, commonly known as a "dipper" arm carrying an excavating implement, the body and/or boom and/or dipper arm and/or excavating implement being relatively movable to enable operations to be carried out, such as earth moving by the implement.

In use of such a machine, it will be appreciated that the postion of the centre of gravity of the machine will shift as the implement is loaded and unloaded, and as the boom is moved relative to the body of the machine, but particularly when the dipper arm is moved relative to the boom to move the implement relative to the body.

Careful attention has to be given, when designing an earth moving machine, to ensure the stability of the machine during operation and particularly to ensure that the machine cannot tip forwardly when the implement is fully loaded and in an outermost position.

It has been proposed to provide a counterweight which can be moved to compensate for these shifts in centre of gravity. One arrangement is shown in Canadian specification CA No. 1008107. In this arrangement the boom is coupled to the counterweight by a mechnaical linkage such that any movement of the boom relative to the body results in a proportional movement of the counterweight.

The counterweight is mounted on a base frame of the machine thus giving good lateral stability, but the machine has distinct disadvantages. Particularly, movement of the counterweight is not in response to movement of the centre of gravity of the machine, which as mentioned above, is caused in the main when the dipper arm is moved relative to the boom.

Further, the boom comprises two mutually pivoted parts each connected by its own hydraulic ram to the body so that the boom parts may move relative to one another. The mechanical linkage which connects the boom ot the counterweight, only moves the counterweight when the first boom part i.e. that boom part nearest the body, moves relative to the body. In practice, because of the articulation of the implement which can be achieved moving only the second boom part and the dipper arm, movement of the first boom part and hence of the counterweight, may not often occur. Hence the counterweight is ineffective.

Accordingly, it is an object of the present invention to provide a new or improved earth moving machine which overcomes these disadvantages and provides additional advantages.

SUMMARY OF THE INVENTION

According to one aspect of the present invention, we provide an earth moving machine comprising a body having a ground engaging propulsion means and a base frame mounted on the ground engaging propulsion means, the base frame being movable relative to the ground engaging propulsion means about a first generally vertical axis, a boom extending outwardly of the body and mounted on the base frame for movement about a second axis transverse relative to the first axis, the boom having mounted at an outer end thereof for movement about a third axis also transverse to the first vertical axis, a dipper arm, an excavating implement mounted at an outer end of the dipper arm for movement about a fourth axis, also transverse relative to the first vertical axis, a hydraulic ram mounted between the dipper arm and the boom to effect movement of the dipper arm relative to the boom and hence to effect movement of the implement towards and away from the body, a counterweight mounted on the base frame, means to move the counterweight towards or away from the first vertical axis, characterized in that movement of the counterweight is in response to movement of the dipper arm relative to the boom towards or away from the body.

Thus the disadvantages associated with the machine described in Canadian Specification CA No. 1008107 are overcome.

The movement of the counterweight may be along an axis generally perpendicular to the first vertical axis so that the centre of gravity of the machine does not shift vertically due to any movement of the counterweight.

Preferably an operator's cab is mounted on the base frame for exmaple on one side thereof, from which an operator may control the operation of the hydraulic ram to enable the operator to control movement of the implement towards and away from the body, from within the operator's cab.

In one embodiment, a sensor is provided to sense any change in relative position between the dipper arm and the boom, the sensor sending a signal to an operating member which moves the counterweight towards or away from the first vertical axis of the machine in proportion to the degree of movement of the dipper arm relative to the boom.

The sensor may comprise an hydraulic sensor, the signal comprising the passage of hydraulic fluid from the sensor towards the operating member which moves the counterweight.

The sensor may comprise a hydraulic ram mounted interiorly of the dipper arm, the plunger or cylinder of the sensor ram being connected to an extension of the boom and the plunger or cylinder of the sensor ram being fixed relative to the dipper arm.

Preferably, a further hydraulic ram is provided to permit movement of the boom relative to the body about the second transverse axis which may be generally horizontal and the sensor may sense changes in pressure within the further hydraulic ram caused by movement of the dipper arm relative to the boom and the magnitude of the load, if any, carried by the implement.

The sensor may also sense changes in pressure within the further hydraulic ram caused by movement of the boom relative to the body.

Alternatively, instead of a hydraulic sensor a control signal which controls valve means which operate the hydraulic ram between the dipper arm and the boom, also controls operation of an operating member which moves the counterweight.

The operating member may thus comprise a further hydraulic ram, movement of a plunger of the further hydraulic ram being proportional to movement of a plunger of the sensor ram as the dipper arm and boom are relatively moved.

Alernatively and preferably the operating member comprises a hydraulic motor which is operatively connected to a lead screw, the screw being fixed relative to the counterweight such that as the screw is rotated by the hydraulic motor in response to the signal, the counterweight is moved towards or away from the first axis.

Preferably, the boom is mounted adjacent its end to the body of the machine, so that no significant part of the boom extends rearwardly of the mounting.

The boom may comprise a single boom part which may be cranked or curved intermediate its ends, to permit the implement to reach to a maximum depth when the boom is in its lowest position, or alternatively, the boom may comprise two or more boom parts. For example, the boom may have a base part secured to the body of the machine and a further part slidable or otherwise movable relative to the base part.

The ground engaging propulsion means preferably comprises two or more endless tracks which may be driven from an engine via a suitable transmission. Alternatively, the ground engaging propulsion means may comprise a chassis having two or more pairs of wheels to enable the body to move relative to the ground. Any other propulsion means may be provided as required.

The base frame may be secured to one part of a slewing ring, and another part of the slewing ring may be secured to the ground engaging propulsion means, the two slewing ring parts being relatively rotatable to permit the base frame to rotate relative to the ground engaging propulsion means about said first vertical axis. Alternatively, any other means to cause the base frame to rotate relative to the ground engaging propulsion means may be provided.

The excavating implement may comprise a bucket mounted on the dipper arm such that the implement is filled as the implement moves towards the body of the machine.

The second, third and fourth axes may be generally perpendicular to the first axis.

BRIEF DESCRIPTION OF THE DRAWINGS

The invention will now be described with the aid of the accompanying drawings, wherein.

DETAILED DESCRIPTION OF THE PREFERRED EMBODIMENTS

Figure 1:
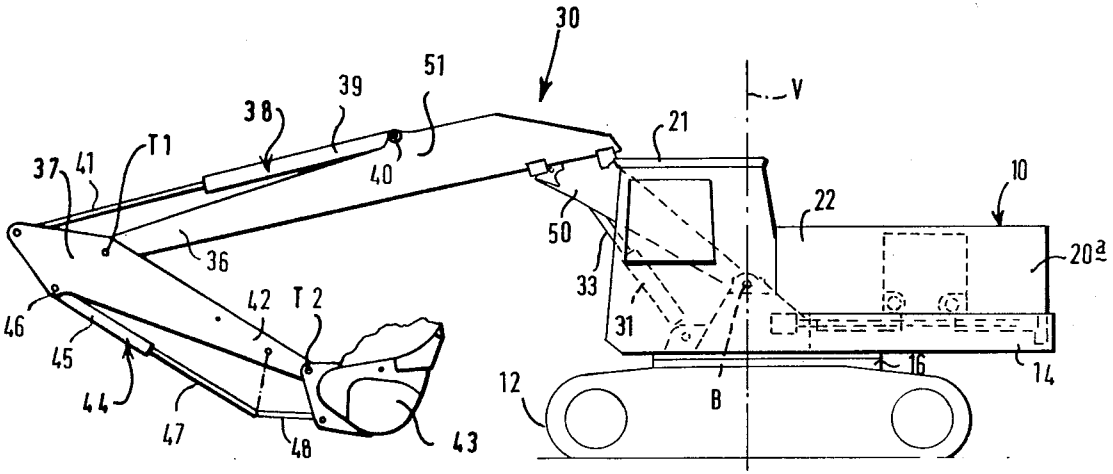
FIG. 1 is a side elevation of an earth moving machine in accordance with the invention.
Figure 2:
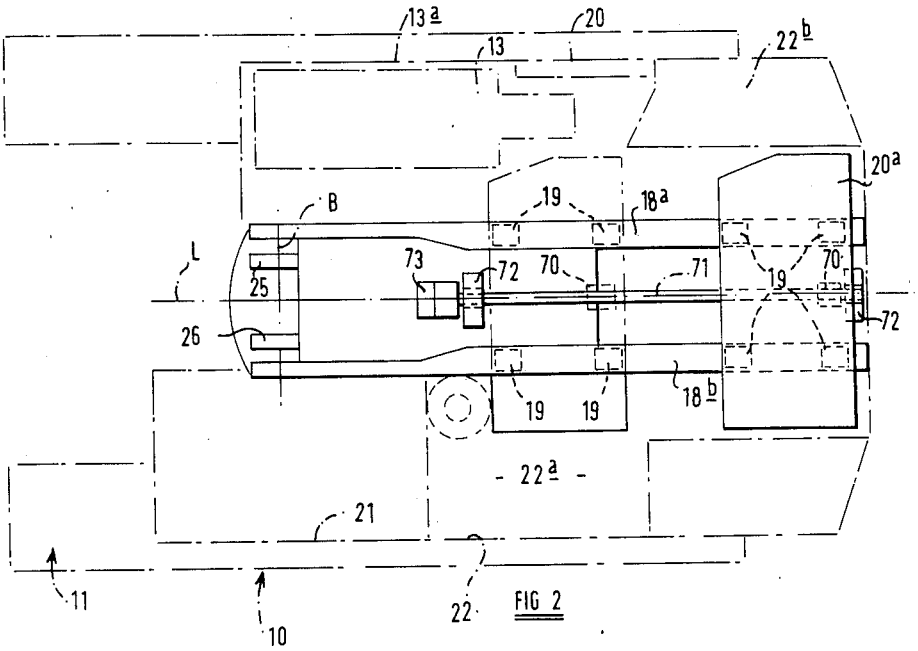
FIG. 2 is a plan view of an upper body part of the earth moving machine of FIG. 1, with the boom omitted for clarity showing the counterweight in full lines in an extended position and in a retracted position in chain dotted lines.

Referring first to FIGS. 1 and 2, an earth moving machine comprises a body 10 including a lower body part comprising a ground engaging propulsion means 11 which, in the present example, comprises a pair of endless tracks 12 driven via a suitable transmission from an engine, the position of the engine being shown diagrammatically at 13 in FIG. 2. Of course, if desired, two or more pairs of wheels may be provided on a chassis or any other ground engaging propulsion means may be provided as required.

Mounted on the ground engaging propulsion means 11 for movement about a first vertical axis V, is an upper body part comprising a base frame 14, the base frame 14 being secured to one part of a conventional slewing ring 16 and another part of the ring 16 which is rotated relative to the one part, being secured to the ground engaging propulsion means 11.

Mounted on the body 10 either side of a longitudinal axis L of the base frame 14 are a plurality of longitudinal members **18*a*,18*b***.

The members **18*a*,18*b* together provide a guide path for a movable counterweight 20*a*, contained within a housing 20 of the upper body part mounted on the base frame 14**, the operation of which is described in detail hereinafter.

Also mounted on the base frame 14 on one side thereof is an operator's cab 21 and superstructure 22, which superstructure 22 provides a space **22*a*** for components such as valves and the like of a hydraulic system of the machine.

The engine 13 is housed in another superstructure **13*a* on the opposite side of the machine to the cab 21 and superstructure 22**.

Centrally mounted on the base frame 14, are two lugs 25, 26, which together provide a support for a boom ram 32 with an engine fuel tank **22*b*. A cylinder part 31 of the hydraulic ram 32 is mounted for pivotal movement on the base frame 14, which ram 32 is provided to effect movement of a boom 30 about a second generally horizontal boom axis B. A plunger 33 of the ram 32 is secured, again for pivotal movement, to the boom 30**.

The boom 30 comprises a base boom part 50 mounted on the base frame 14 for rotation about boom axis B, and a further boom part 51 mounted on the base boom part 50 for sliding movement under the action of a manual or power assisted means as required. Such a sliding boom arrangement is shown in our prior U.K. patent No. 2,014,149 and thus detailed description of the boom parts is not required.

At an outer end 36 of the boom part 51, a dipper arm 37 is mounted for movement relative to the boom 30 about an axis $T_1$ transverse i.e. generally perpendicular to vertical axis V. To effect movement of the dipper arm 37 relative to the boom 30, a hydraulic ram 38 is provided, a cylinder part 39 of which is pivotally secured to the boom part 51 as shown at 40, and plunger 41 of which is pivotally secured to dipper arm 37. At the outer end 42 of the dipper arm 37 an implement comprising, in this instance, a bucket 43 is mounted for pivotal movement relative to the dipper arm 37 about a fourth axis $T_2$, again transverse to the vertical axis V of the machine.

To effect pivotal movement of the bucket 43, another hydraulic ram 44 is provided, a cylinder part 45 of which is secured in pivotal manner to the dipper arm 37 as shown at 46, and a plunger 47 of which is secured in pivotal manner via a linkage 48 to the bucket 43. Of course, if desired any other suitable excavating implement may be mounted on the end 42 of dipper arm 37 in place of the bucket 43, and movement of the implement relative to the dipper arm 37 could be achieved by connecting hydraulic ram 44 to the implement and dipper arm in any other manner.

The hydraulic rams 32, 38 and 44 are each supplied with hydraulic fluid under pressure from one or more pumps via suitable pipes, including flexible pipes where necessary, as is well known in the art. The rams 32, 38 and 44 are each controlled from within the operator's cab 21 mounted on the base frame, so that an operator has complete control over operation of the boom 30, dipper arm 37 and implement 43.

Thus movement of the dipper arm 37 relative to the boom 30 can be effected by hydraulic ram 38.

It will be appreciated that as the boom 30 and dipper arm 37 extend a significant distance from the base frame 14, as the bucket 43 moves towards and away from the base frame, considerable changes in the centre of gravity of the base frame 14 and ground engaging propulsion means 11 will be caused. To counter this, the counterweight 20*a*, is mounted, as hereinbefore described, for movement towards and away from vertical axis V.

The counterweight 20*a* is made in cast iron. In FIG. 1, the counterweight 20*a*, is shown in an intermediate extended position as the dipper arm 37 is not in a fully outstretched position relative to the boom 30.

In FIG. 2 the counterweight 20*c* is shown in an extended position in full lines, and a retracted position in chain dotted lines.

The counterweight 20*a*, has rollers 19 which roll on longitudinal members 18*a*,18*b* and a captive nut 70. The captive nut 70 receives a lead screw 71 which is also located in bearings 72. The lead screw 71 is adapted to be rotated by a reversible hydraulic motor 73.

The motor 73 is operated under the control of a control means described hereinafter with reference to FIG. 3 or FIG. 4, such that when the centre of gravity of the machine shifts forwardly in the direction of boom extension for example as the dipper arm 37 and hence implement 43 is moved outwardly relative to the body 10 of the machine by ram 38, the counterweight 20*a*, is moved outwardly away from axis V by virtue of the lead screw 71 rotating within the captive nut 70, to counterbalance the machine.

Conversely when the centre of gravity shifts in an opposite direction, for example as the dipper arm 37 and hence implement 43 is moved inwardly relative to the body 10 of the machine, the counterweight 20*a*, is moved inwardly towards axis V, again by virtue of the lead screw 71 rotating, but in an opposite direction, within the captive nut 70.

Figure 3:
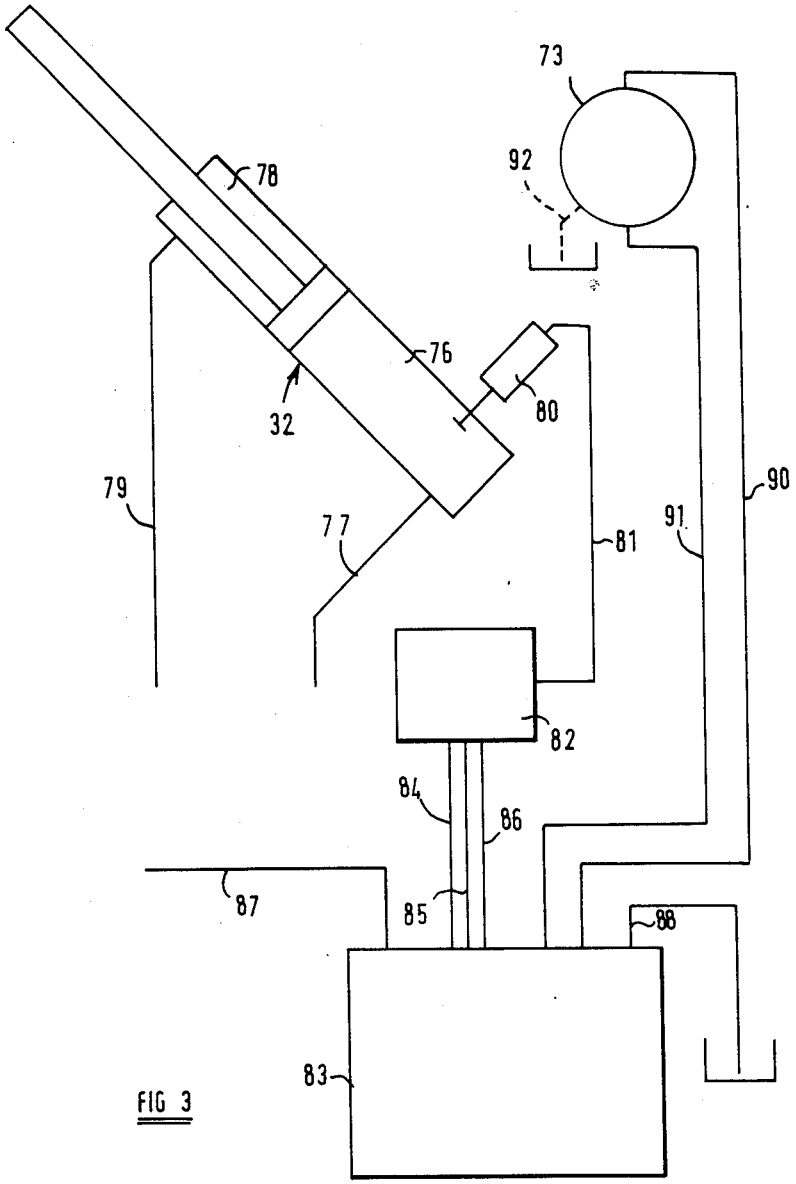
FIG. 3 is a diagrammatic representation of part of the hydraulic system of the earth moving machine of FIGS. 1 and 2.

Referring now to FIG. 3, part of one example of a hydraulic system for use with a machine in accordance with the invention is shown diagrammatically.

When the boom 30 is moved clockwise as hereinbefore described, fluid is fed under pressure to the non-annulus side 76 of the boom ram 32 along a hydraulic line 77, under the control of control valves operable from within the operator's cab 21. Conversely, when the boom 30 is moved anticlockwise as hereinbefore described, fluid is fed under pressure to the annulus side 78 of ram 32 along line 79.

Such an arrangement is well known in the art and detailed description is not considered necessary.

A hydraulic sensor 80 is provided to sense the hydraulic pressure in the non-annulus side 76 of ram 32, which sensor 80 sends a signal i.e. hydraulic fluid, along a line 81 to a receiver 82 which smooths the signal from sensor 80 and provides a command to a control unit 83 via one of three control lines 84,85,86.

The control unit 83 receives hydraulic fluid under pressure along line 87 and has an outlet 88 to the hydraulic fluid reservoir.

When the sensor 80 senses an increase in pressure in the non-annulus side 76 of ram 32, the receiver 82 sends a signal to control unit 83 to open a spool valve within the unit so that hydraulic fluid from the supply 87 flows to the hydraulic motor 73 via line 90.

Such an increase in pressure would occur for example if the dipper arm 37 is moved outwardly which would cause the centre of gravity of the machine to move forwardly. The motor 73 is thus arranged to operate to rotate lead screw 71 to move the counterweight 20*a*, away from axis V to counterbalance the machine.

When sensor 80 senses a decrease in pressure, the receiver 82 sends a signal to control unit 83 to open an alternative valve so that fluid is fed to the motor 73 along line 91 which causes the motor 73 to operate in an opposite direction so that the counterweights 20*a*, is moved towards axis V. Such a decrease in pressure in the non-annulus side 76 of ram 32 could occur for example, as the dipper arm 37 is moved inwardly towards the body 10 of the machine.

The motor 73 has a an outlet 92 to the hydraulic fluid reservoir.

It will be appreciated that any movement of the boom 30 relative to the body, or especially of the dipper arm 37 relative to the boom 30, will shift the centre of gravity of the machine and this shift will be sensed by hydraulic sensor 80 which provides a signal to an operating member which moves the counterweight 20*a*, the operating member in this example comprising motor 73.

Any other type of hydraulic sensing arrangement could be used such as that shown in FIG. 5 hereinafter, or any other type of operating member to move counterweight 20*a*, could be used, an alternative again being shown in FIG. 5.

Figure 4:
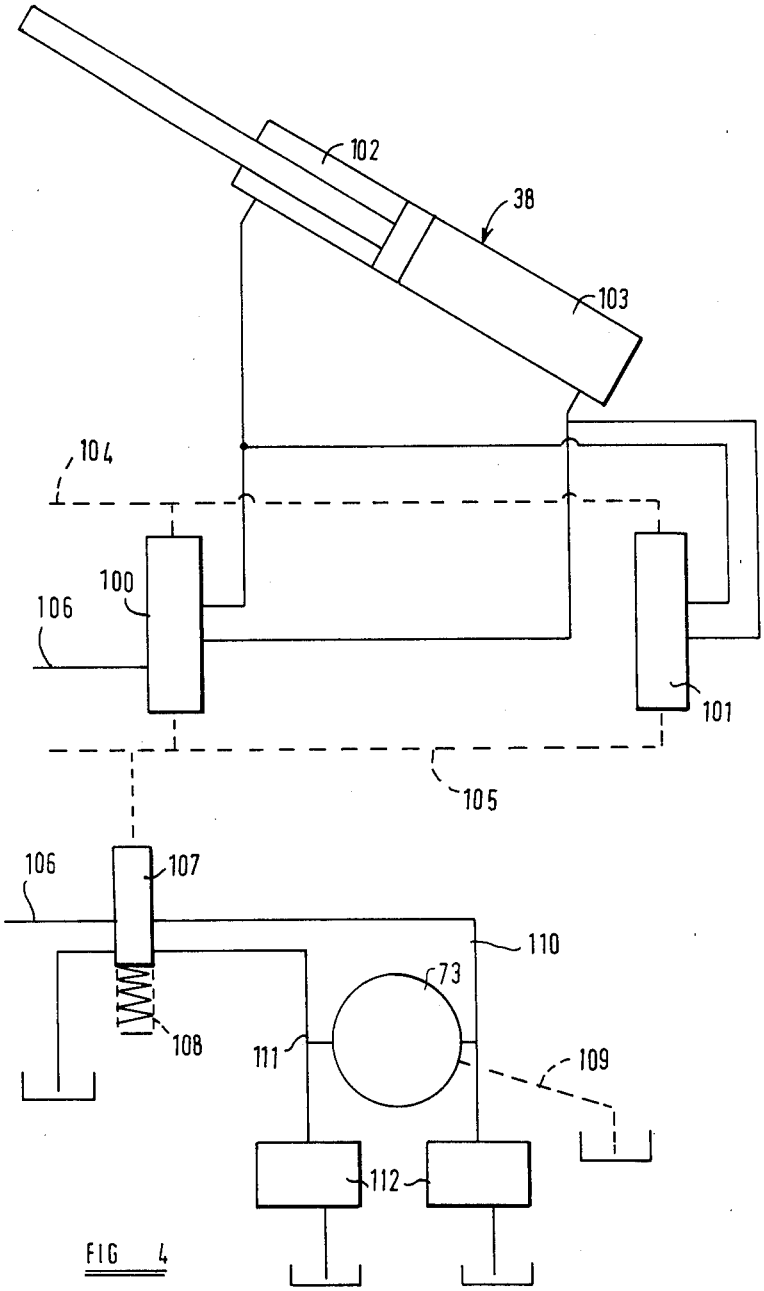
FIG. 4 is a diagrammatic representation of part of an alternative hydraulic system for an earth moving machine in accordance with the invention.

However referring first to FIG. 4, instead of a hydraulic sensor sensing changes in the pressure within ram 32 between the boom and the body 10, the movement of the counterweight 20*a*, is coupled to movement of the plunger 41 of dipper ram 38.

A pair of spool valves 100,101, are provided to feed hydraulic fluid under pressure to the annulus side 102 of the ram 38 to move the dipper arm 37 and hence the implement 43 away from the body 10 of the machine, or to non-annulus side 103 to move the dipper arm 37 and hence the implement 43 towards the body 10.

The valves 100,101 are operated to direct fluid to the annulus side 102 when a pilot pressure is received along line 104 from a manual valve within the operator's cab 21, or to direct fluid to the non-annulus side 103 when a pilot pressure is received along a line 105, again from the manual valve.

Fluid is pumped to the valves 100,101 from a supply 106 and a separate supply also feeds another valve 107. The valve 107 is normally spring biased by spring 108 to direct fluid along line 110 to the motor 73 to move the counterweight 20*a*, to a fully retracted position and again the motor has a drain 109 to direct the fluid pumped to the motor 73 when for example the counterweight 20*a*, is in its fully extended position, to a reservoir.

However, when a pilot pressure is received from line 105 as the dipper arm 37 is moved towards the body, the valve 107 acts against spring 108 to direct fluid to the motor 73 along line 111 to cause the motor 73 to operate to move the counterweight 20*a*, to the extended position. Limit switches 112 are provided in each of the lines 110,111, to relieve pressure in the lines 110,111, when the counterweight 20*a*,is in its fully extended or its retracted positions.

Figure 5:
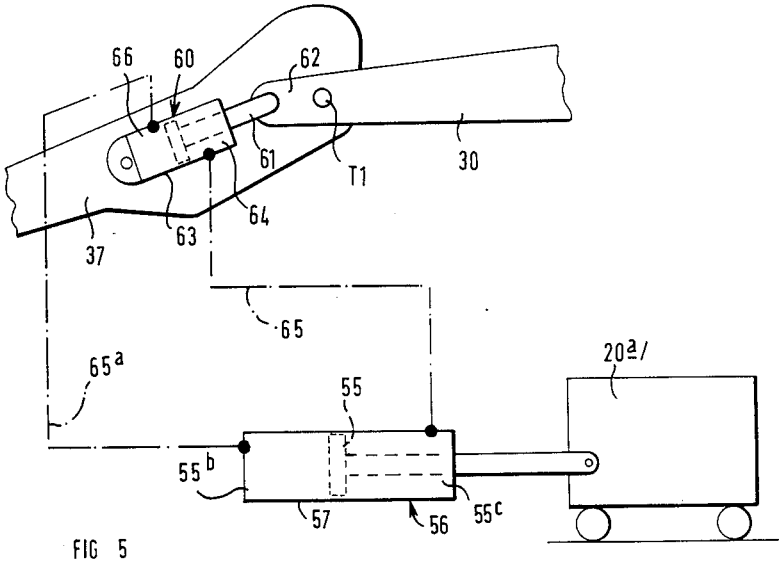
FIG. 5 is a diagrammatic representation of part of the hydraulic system of a modified system in accordance with the invention.

Referring now to FIG. 5, an alternative arrangement is shown for a modified machine in accordance with the invention. Instead of a motor 73 and lead screw 71, secured to counterweight 20*a* is a plunger 55 of a further hydraulic ram 56, a cylinder part 57 of which is secured to the base frame 14. As hydraulic pressure is increased in the cylinder part 57 in a non-annulus region 55*b*, the counterweight 20*a*, will be moved away from vertical axis V of the machine. Conversely, where hydraulic pressure in the cylinder part 57 in the annulus region 55*c* of the cylinder 57 is increased, the plunger 55 will be urged inwardly of the cylinder part 57 to thereby move the counterweight 20*a* towards the vertical axis V.

The position of the counterweight 20*a*, is controlled automatically by means of a still further hydraulic arm 60 which is mounted between dipper arm 37 and boom 30 interiorly of the dipper arm 37. A plunger 61 of the ram 60 is pivotally secured to an extension 62 of the boom 30, whilst a cylinder part 63 thereof is secured firmly to the dipper arm 37. The mounting of the plunger 61 on the boom 30 permits of pivotal movement, and the mounting of the cylinder part 63 interiorly of the dipper arm 37 also permits such movement.

It will be appreciated therefore that as ram 38 is operated to move the bucket 43 outwardly, or as the winch means 50 is operated to move the bucket 43 inwardly, that the plunger 61 of ram 60 will be urged inwardly or outwardly of its cylinder 63 a corresponding amount.

Annulus region 64 of the cylinder part 63 of ram 60 is connected via a hydraulic line 65 to annulus region 55*c* of the ram 56. Thus, as fluid is urged from region 64 of the cylinder part 63 as the bucket 43 moves towards the body 10, fluid will be injected into the cylinder part 55*c* of the ram 56 to urge the plunger 55 inwardly. Thus the counterweight 20*a*, will be moved towards the axis V. Conversely, as fluid is urged from region 66 of the ram 60 as the bucket 43 moves away from the body 10, this fluid will be transmitted via a further hydraulic line 65*a* to behind the plunger 55 of ram 56 to urge the plunger 55 outwardly of the ram 56, and hence move the counterweight 20 away from the axis V.

The hydraulic system is a closed system so that no fluid is added to or lost from the system during operation, so that movement of plunger 55 is always proportional to the movement of plunger 61 and hence movement of the counterweight 20 is proportional to the relative movement between the dipper arm 37 and boom 30.

By arranging for specific relative sizes of ram 56 and 60, a desired inward or outward movement of the counterweight 20*a*, can thus be achieved for a given movement of the bucket 43 towards or away from the body 10, automatically. Thus the stability of the machine 10 is maintained as the bucket 43 is moved.

The machines described have at least the following other advantages over known earth moving machines, namely:

In each of the hydraulic sensing arrangements described, the movement of the dipper arm 37 relative to the boom 30, which is a major factor effecting the centre of gravity of the machine, is sensed.

Because the boom parts 50,51, slide relatively compared with the mutual pivoting permitted in the arrangement described in Canadian specification CA No. 1008107, for example, only one boom ram 32 (or in practice two rams which act together and are pivoted about the same axes) need be provided permitting greater degrees of movement of the implement 43.

The hydraulic sensing arrangement associated with the boom and the dipper arm permit the counterweight 20*a*, to be moved in a manner controlled largely by shifts of the centre of gravity of the machine. This compares favourably with the arrangement of the Canadian specification CA No. 1008107 in which movement of the counterweight is achieved by a direct mechanical link between the boom and the body.

Various modifications may be made to the machines described without departing from the scope of the invention. For example, it is not essential for the hydraulic rams 32, 38, 44, to be mounted as described, but alternative arrangements are possible.

The sensor ram 60 as described with reference to FIG. 5 is mounted interiorly of the dipper arm 37, but could of course be mounted exteriorly thereof or even within the boom as required. Further, if desired, instead of fluid provided as a pilot signal to control ram 38, being used to move the counterweight, as described in FIG. 4, with suitable hydraulic circuitry, a proportion of the fluid actually fed to or from hydraulic ram 38 may be used to provide a signal to an operating member to move the counterweight 20*a*, towards or away from vertical axis V a required proportional amount.

If desired, the boom 30 may be mounted off centre of the axis L of the vehicle, in which case the operator's cab 21 and superstructure 22 could be provided in alternative positions.

The counterweight 20*a*, need not move on a guide path comprising longitudinal members 18*a*,18*b* on rollers 19 as described, but any other means to effect movement of counterweight 20*a*, or more or less than two counterweights as the centre of gravity of the machine changes, may be provided.

In place of the compound boom and dipper arrangement as described with reference to FIGS. 1 and 2 if desired, an alternative compound boom and dipper arm arrangement may be provided, in which a base part of a boom could be mounted on the base frame 14 and a further part of the boom may be pivotable relative to the base part by hydraulically powered or other power means as required, or a unitary boom may be provided, which may be curved, cranked or straight as required.

We claim:

1. An earth moving machine comprising a body having a ground engaging propulsion means, a base frame, means mounting the base frame on the ground engaging propulsion means, for movement relative to the ground engaging propulsion means about a first generally vertical axis, a boom extending outwardly of the body, means mounting the boom at one end thereof, on the base frame for movement about a second axis transverse relative to the first axis, a hydraulic ram mounted between the base frame and the boom for effecting said movement of the boom about the second axis, a dipper arm, means mounting the dipper arm at an outer end of the boom for movement about a third axis also transverse to the first vertical axis, a hydraulic ram mounted between the dipper arm and the boom to effect movement of the dipper arm relative to the boom about the third axis and hence to effect movement of the implement towards and away from the body, an excavating implement, means mounting the excavating implement at an outer end of the dipper arm for movement about a fourth axis also transverse relative to the first vertical axis, a hydraulic ram mounted between the dipper arm and the excavating implement to effect said movement of the excavating arm about the fourth axis, a counterweight, means mounting the counterweight directly on the base frame for sliding generally horizontal movement towards and away from the first vertical axis, hydraulic sensing means which sense movement of the dipper arm relative to the boom about the third axis, and fluid means for effecting said sliding generally horizontal movement of the counterweight in response to said movement of the dipper arm relative to the boom sensed by the sensing means and hence in response to movement of the implement towards and away from the body, wherein a control signal which controls valve means which operates the hydraulic ram between the dipper arm and the boom, also controls operation of an operating member which moves the counterweight.

2. A machine according to claim 1 wherein the operating member comprises a hydraulic motor which is operatively connected to a lead screw, the screw being fixed relative to the counterweight such that as the screw is rotated by the hydraulic motor in response to the signal, the counterweight is moved towards and away from the first axis.

* * * * *